US007118651B2

(12) United States Patent
Aldrich

(10) Patent No.: US 7,118,651 B2
(45) Date of Patent: Oct. 10, 2006

(54) PRESS FELT

(75) Inventor: William Daniel Aldrich, Wilson, NC (US)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 629 days.

(21) Appl. No.: 10/400,430

(22) Filed: Mar. 27, 2003

(65) Prior Publication Data

US 2004/0221913 A1 Nov. 11, 2004

(51) Int. Cl.
*D21F 7/08* (2006.01)
*D03D 3/04* (2006.01)

(52) U.S. Cl. ..... 162/358.2; 162/900; 162/903; 442/207; 139/383 A

(58) Field of Classification Search ..... 162/116, 162/117, 361, 358.1, 358.2, 348, 900, 902, 162/903; 139/383 A, 425 A; 28/110, 142; 442/203–207, 267–271
See application file for complete search history.

(56) References Cited

U.S. PATENT DOCUMENTS 6,077,397 A 6/2000 Shipley
6,883,556 B1 * 4/2005 Fahrer et al. ..... 139/383 A
6,896,009 B1 * 5/2005 Ward ..... 139/383 A
2003/0217782 A1 * 11/2003 Nagura et al. ..... 139/383 A
2004/0182465 A1 * 9/2004 Ward ..... 139/383 A

FOREIGN PATENT DOCUMENTS

EP 0 590 927 A1 4/1994
JP 2003-342889 * 3/2003
WO WO 80/01086 A 5/1980
WO WO 93/01350 A 1/1993

OTHER PUBLICATIONS

European Search Report Appl. No.: EP 04 10 1203; Date of Completion of Search: Sep. 24, 2004.

* cited by examiner

*Primary Examiner*—Eric Hug
(74) *Attorney, Agent, or Firm*—Notaro & Michalos PC

(57) ABSTRACT

A press felt comprises a base fabric, optionally with a batt of fibrous material needled thereto. The base fabric is woven endless, having upper and lower layers of weft yarns and first and second sets of warp yarns. The first set of warp yarns interweaves with at least the upper layer of wefts and the second set of warp yarns interweaves with at least the lower set of wefts. At least some of the first set of warps at least occasionally interweave with the lower wefts and at least some of the second set of warps at least occasionally interweaves with the upper wefts.

8 Claims, 3 Drawing Sheets

FIG. 3

Add extra warp end #2 in right edge with cord

Harness Number →

Pick ↓

| Pick | 1 | 2 | 3 | 4 | 5 | 6 | 7 | 8 | 9 | 10 | 11 | 12 | 13 | 14 | 15 | 16 | 17 | Shuttle Box: Left | Shuttle Box: Right | | Pick From | Cloth | | Loop Yarn: Bot | Loop Yarn: Top | Pick |
|---|---|---|---|---|---|---|---|---|---|---|---|---|---|---|---|---|---|---|---|---|---|---|---|---|---|---|
| 1 | - | 2 | - | - | - | 6 | - | 8 | - | 10 | - | - | - | 14 | - | 16 | 17 | 1 | 1 | | R | T | | - | X | 1 |
| 2 | - | 2 | - | 4 | - | 6 | 7 | 8 | - | 10 | - | 12 | - | 14 | 15 | 16 | - | 1 | 1 | | L | B | | - | X | 2 |
| 3 | 1 | 2 | 3 | 4 | - | 6 | 7 | 8 | 9 | 10 | 11 | 12 | - | 14 | 15 | 16 | 17 | 1 | 1 | | R | B | | - | X | 3 |
| 4 | - | 2 | - | - | - | - | - | - | - | 10 | - | - | - | - | - | - | - | 1 | 1 | | L | T | | - | - | 4 |
| 5 | - | 2 | - | 4 | - | - | - | 8 | - | 10 | - | 12 | - | - | - | 16 | 17 | 1 | 1 | | R | T | | - | X | 5 |
| 6 | 1 | 2 | - | 4 | - | 6 | - | 8 | 9 | 10 | - | 12 | - | 14 | - | 16 | - | 1 | 1 | | L | B | | - | X | 6 |
| 7 | 1 | 2 | - | 4 | 5 | 6 | 7 | 8 | 9 | 10 | - | 12 | 13 | 14 | 15 | 16 | 17 | 1 | 1 | | R | B | | X | X | 7 |
| 8 | - | - | - | - | - | - | - | 8 | - | - | - | - | - | - | - | 16 | - | 1 | 1 | | L | T | | - | X | 8 |
| 9 | - | 2 | - | - | - | 6 | - | 8 | - | 10 | - | - | - | 14 | - | 16 | 17 | 1 | 1 | | R | T | | - | X | 9 |
| 10 | - | 2 | - | 4 | - | 6 | 7 | 8 | - | 10 | - | 12 | - | 14 | 15 | 16 | - | 1 | 1 | | L | B | | - | X | 10 |
| 11 | 1 | 2 | 3 | 4 | - | 6 | 7 | 8 | 9 | 10 | 11 | 12 | - | 14 | 15 | 16 | 17 | 1 | 1 | | R | B | | - | X | 11 |
| 12 | - | 2 | - | - | - | - | - | - | - | 10 | - | - | - | - | - | - | - | 1 | 1 | | L | T | | - | - | 12 |
| 13 | - | 2 | - | 4 | - | 6 | - | - | - | 10 | - | 12 | - | - | - | 16 | 17 | 1 | 1 | | R | T | | - | X | 13 |
| 14 | 1 | 2 | - | 4 | - | 6 | - | 8 | - | 10 | 11 | 12 | - | 14 | - | 16 | - | 1 | 1 | | L | B | | - | X | 14 |
| 15 | 1 | 2 | - | 4 | 5 | 6 | 7 | 8 | - | 10 | 11 | 12 | 13 | 14 | 15 | 16 | 17 | 1 | 1 | | R | B | | X | X | 15 |
| 16 | - | - | - | - | - | 6 | - | - | - | - | - | - | - | - | - | 16 | - | 1 | 1 | | L | T | | - | X | 16 |
| 17 | - | 2 | - | - | - | 6 | - | 8 | - | 10 | - | - | - | 14 | - | 16 | 17 | 1 | 1 | | R | T | | - | X | 17 |
| 18 | - | 2 | - | 4 | - | 6 | 7 | 8 | - | 10 | - | 12 | - | 14 | 15 | 16 | - | 1 | 1 | | L | B | | - | X | 18 |
| 19 | 1 | 2 | 3 | 4 | - | 6 | 7 | 8 | 9 | 10 | 11 | 12 | - | 14 | 15 | 16 | 17 | 1 | 1 | | R | B | | - | X | 19 |
| 20 | - | 2 | - | - | - | - | - | - | - | 10 | - | - | - | - | - | - | - | 1 | 1 | | L | T | | - | - | 20 |
| 21 | - | 2 | - | 4 | - | - | - | 8 | - | 10 | - | 12 | - | - | - | 16 | 17 | 1 | 1 | | R | T | | - | X | 21 |
| 22 | 1 | 2 | - | 4 | - | 6 | - | 8 | 9 | 10 | - | 12 | - | 14 | - | 16 | - | 1 | 1 | | L | B | | - | X | 22 |
| 23 | 1 | 2 | - | 4 | 5 | 6 | 7 | 8 | 9 | 10 | - | 12 | 13 | 14 | 15 | 16 | 17 | 1 | 1 | | R | B | | X | X | 23 |
| 24 | - | - | - | - | - | - | - | 8 | - | - | - | - | - | - | - | 16 | - | 1 | 1 | | L | T | | - | X | 24 |
| 25 | - | 2 | - | - | - | 6 | - | 8 | - | - | - | 12 | - | 14 | - | 16 | 17 | 1 | 1 | | R | T | | - | X | 25 |
| 26 | - | 2 | - | 4 | 5 | 6 | - | 8 | - | 10 | - | 12 | - | 14 | 15 | 16 | - | 1 | 1 | | L | B | | - | X | 26 |
| 27 | 1 | 2 | 3 | 4 | 5 | 6 | - | 8 | 9 | 10 | 11 | 12 | - | 14 | 15 | 16 | 17 | 1 | 1 | | R | B | | - | X | 27 |
| 28 | - | 2 | - | - | - | - | - | - | - | - | - | 12 | - | - | - | - | - | 1 | 1 | | L | T | | - | - | 28 |
| 29 | - | 2 | - | 4 | - | - | - | 8 | - | 10 | - | 12 | - | - | - | 16 | 17 | 1 | 1 | | R | T | | - | X | 29 |
| 30 | 1 | 2 | - | 4 | - | 6 | - | 8 | 9 | 10 | - | 12 | - | 14 | - | 16 | - | 1 | 1 | | L | B | | - | X | 30 |
| 31 | 1 | 2 | - | 4 | 5 | 6 | 7 | 8 | 9 | 10 | - | 12 | 13 | 14 | 15 | 16 | 17 | 1 | 1 | | R | B | | X | X | 31 |
| 32 | - | - | - | - | - | - | - | 8 | - | - | - | - | - | - | - | 16 | - | 1 | 1 | | L | T | | - | X | 32 |
| 33 | - | 2 | - | - | - | 6 | - | 8 | - | 10 | - | - | - | 14 | - | 16 | 17 | 1 | 1 | | R | T | | - | X | 33 |
| 34 | - | 2 | - | 4 | - | 6 | 7 | 8 | - | 10 | - | 12 | - | 14 | 15 | 16 | - | 1 | 1 | | L | B | | - | X | 34 |
| 35 | 1 | 2 | 3 | 4 | - | 6 | 7 | 8 | 9 | 10 | 11 | 12 | - | 14 | 15 | 16 | 17 | 1 | 1 | | R | B | | - | X | 35 |
| 36 | - | 2 | - | - | - | - | - | - | - | 10 | - | - | - | - | - | - | - | 1 | 1 | | L | T | | - | - | 36 |
| 37 | - | 2 | - | 4 | - | - | - | 8 | - | 10 | - | 12 | - | - | - | 16 | 17 | 1 | 1 | | R | T | | - | X | 37 |
| 38 | 1 | 2 | - | 4 | - | 6 | - | 8 | 9 | 10 | - | 12 | - | 14 | - | 16 | - | 1 | 1 | | L | B | | - | X | 38 |
| 39 | 1 | 2 | - | 4 | 5 | 6 | 7 | 8 | 9 | 10 | - | 12 | 13 | 14 | 15 | 16 | 17 | 1 | 1 | | R | B | | X | X | 39 |
| 40 | - | - | - | - | - | - | - | 8 | - | - | - | - | - | - | - | 16 | - | 1 | 1 | | L | T | | - | X | 40 |
| 41 | - | - | - | 4 | - | 6 | - | 8 | - | 10 | - | - | - | 14 | - | 16 | 17 | 1 | 1 | | R | T | | - | X | 41 |
| 42 | - | 2 | - | 4 | - | 6 | 7 | 8 | - | 10 | - | 12 | 13 | 14 | - | 16 | - | 1 | 1 | | L | B | | - | X | 42 |
| 43 | 1 | 2 | 3 | 4 | - | 6 | 7 | 8 | 9 | 10 | 11 | 12 | 13 | 14 | - | 16 | 17 | 1 | 1 | | R | B | | - | X | 43 |
| 44 | - | - | - | 4 | - | - | - | - | - | 10 | - | - | - | - | - | - | - | 1 | 1 | | L | T | | - | - | 44 |
| 45 | - | 2 | - | 4 | - | - | - | 8 | - | 10 | - | 12 | - | - | - | 16 | 17 | 1 | 1 | | R | T | | - | X | 45 |
| 46 | 1 | 2 | - | 4 | - | 6 | - | 8 | 9 | 10 | - | 12 | - | 14 | - | 16 | - | 1 | 1 | | L | B | | - | X | 46 |
| 47 | 1 | 2 | - | 4 | 5 | 6 | 7 | 8 | 9 | 10 | - | 12 | 13 | 14 | 15 | 16 | 17 | 1 | 1 | | R | B | | X | X | 47 |
| 48 | - | - | - | - | - | - | - | 8 | - | - | - | - | - | - | - | 16 | - | 1 | 1 | | L | T | | - | X | 48 |
| 49 | - | 2 | - | - | - | 6 | - | 8 | - | 10 | - | - | - | 14 | - | 16 | 17 | 1 | 1 | | R | T | | - | X | 49 |
| 50 | - | 2 | - | 4 | - | 6 | 7 | 8 | - | 10 | - | 12 | - | 14 | 15 | 16 | - | 1 | 1 | | L | B | | - | X | 50 |
| 51 | 1 | 2 | 3 | 4 | - | 6 | 7 | 8 | 9 | 10 | 11 | 12 | - | 14 | 15 | 16 | 17 | 1 | 1 | | R | B | | - | X | 51 |
| 52 | - | 2 | - | - | - | - | - | - | - | 10 | - | - | - | - | - | - | - | 1 | 1 | | L | T | | - | - | 52 |
| 53 | - | 2 | - | 4 | - | - | - | 8 | - | 10 | - | 12 | - | - | - | 16 | 17 | 1 | 1 | | R | T | | - | X | 53 |
| 54 | 1 | 2 | - | 4 | - | 6 | - | 8 | 9 | 10 | - | 12 | - | 14 | - | 16 | - | 1 | 1 | | L | B | | - | X | 54 |
| 55 | 1 | 2 | - | 4 | 5 | 6 | 7 | 8 | 9 | 10 | - | 12 | 13 | 14 | 15 | 16 | 17 | 1 | 1 | | R | B | | X | X | 55 |
| 56 | - | - | - | - | - | - | - | 8 | - | - | - | - | - | - | - | 16 | - | 1 | 1 | | L | T | | - | X | 56 |
| 57 | - | 2 | - | - | - | 6 | - | 8 | - | 10 | - | - | - | 14 | - | 16 | 17 | 1 | 1 | | R | T | | - | X | 57 |
| 58 | - | 2 | - | 4 | - | 6 | 7 | 8 | - | 10 | - | 12 | - | 14 | 15 | 16 | - | 1 | 1 | | L | B | | - | X | 58 |
| 59 | 1 | 2 | 3 | 4 | - | 6 | 7 | 8 | 9 | 10 | 11 | 12 | - | 14 | 15 | 16 | 17 | 1 | 1 | | R | B | | - | X | 59 |
| 60 | - | 2 | - | - | - | - | - | - | - | 10 | - | - | - | - | - | - | - | 1 | 1 | | L | T | | - | - | 60 |
| 61 | - | 2 | - | 4 | - | - | - | 8 | - | 10 | - | 12 | - | 14 | - | - | 17 | 1 | 1 | | R | T | | - | X | 61 |
| 62 | - | 2 | 3 | 4 | - | 6 | - | 8 | 9 | 10 | - | 12 | - | 14 | - | 16 | - | 1 | 1 | | L | B | | - | X | 62 |
| 63 | - | 2 | 3 | 4 | 5 | 6 | 7 | 8 | 9 | 10 | - | 12 | 13 | 14 | 15 | 16 | 17 | 1 | 1 | | R | B | | X | X | 63 |
| 64 | - | - | - | - | - | - | - | 8 | - | - | - | - | - | 14 | - | - | - | 1 | 1 | | L | T | | - | X | 64 |

PRESS FELT

The present invention relates to press felts for use in the press section of a papermaking machine.

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Paper machine clothing is essentially employed to carry the paper web through these various stages of the papermaking machine. In the forming section, the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. Press fabrics generally comprise a batt of fibres needled to a base fabric. In the final stage, the paper web is transferred either to a Yankee dryer, in the case of tissue paper manufacture, or to a set of dryer cylinders upon which, aided by the clamping action of the dryer fabric, the majority of the remaining water is evaporated.

U.S. Pat. No. 5,152,326, discloses a forming fabric wherein upper and lower fabrics, each comprising warp and weft yarns, are bound together using pairs of binding threads. These binding threads are fabric borne threads, which complete the plain weave pattern in the paper contacting surface.

U.S. Pat. No. 4,605,585 again discloses a two layer forming fabric which has an upper layer comprising fine yarns and a lower wear layer comprising coarser yarns. The two sets of yarns are bound together by pairs of yarns, which between them complete a given weave in both layers.

EP 1000195B1 discloses a double layer, flat woven, papermachine fabric, which would have particular application as a dryer fabric. The two layers of stacked cross machine direction (CD) yarns are interwoven with pairs of machine direction (MD) yarns, which between them weave and bind the layers of cd yarns together, giving a plain weave on both surfaces. Seaming of the flat woven fabric is also described. This would be extremely complicated.

Press fabrics are very different in construction from forming and dryer fabrics. Forming and dryer fabrics are woven flat, where the yarns of the warp in the loom lie in the machine direction of the fabric on the papermachine. In the case of forming fabrics, once the fabric has been woven to its full length, the final section of wefts at each end are removed and the warp ends are then rewoven with new weft yarns to provide an endless loop. In the case of dryer fabrics, once sections of weft yarns have been removed at each end, the warps are rewoven back into the main body of the fabric, forming seam loops. These are then inter-connected, by means of a pintle wire, once the fabric is in position on the papermachine.

Press fabrics on the other hand are woven endless, whether they are seamed or not, such that the yarns of the weft in the loom lie in the machine direction of the fabric on the papermachine. Press felts consist of multiple layers which are secured together by needling. This works by mechanically locking the constituent batt fibres into the various layers and in doing so holds them altogether.

There are a number of standard bases for seamed press felts. These can either consist of one woven fabric which is a double layer fabric or of two fabrics, woven separately, which are then needled together.

There are a number of problems that have been encountered when using known press felts having double layer base cloths.

In endless weaving, tensioning differences between the warp in the top and bottom layers can cause an effect known as hour-glassing. This term is used to describe the behaviour of a press felt, whereby part of it differentially contracts or expands in width.

Base collapse is another problem associated with weaves currently used for double layer press fabrics. For example, a standard 3×1 weave consists of pairs of stacked md yarns, which are held in place by one cd yarn. This means that only every fourth upper surface yarn, in any one cd yarn path, has a knuckle going over it. Between knuckles the warp yarn floats internally on the way to the back side, and floats internally on the way again to the face side. The binding is therefore loose and the yarns are not locked very securely in position and so are able to move fairly freely within the structure. The fabric is thus prone to collapse, on compression, as it goes through the nips in the press machine, the upper layer of yarns tending to be pushed into the lower layer. This has the effect of closing down both the permeability and the void volume of the fabric. It is therefore more difficult for the water to pass through the fabric and also there is less space available within the fabric to carry the water away.

In a further known embodiment of press felts, where two woven substrates are needled together, there can be problems associated with fitting one fabric around the other, due to size issues and/or differential shrinkage. Furthermore, if one of the fabrics is not completely in phase with the other this may cause localised blockage and/or collapse if the upper yarns are pushed down in between yarns of the lower layer. This reduction in thickness causes an indentation in a given region which, if picked up by the press roll, causes undesirable press vibration.

The present invention has been made from a consideration of the aforementioned problems.

According to the present invention there is provided a press felt comprising a base fabric, optionally with a batt of fibrous material secured thereto, the base fabric being woven endless and comprising upper and lower layers of weft yarns and first and second sets of warp yarns, wherein the first set of warp yarns interweaves with at least the upper layer of wefts and the second set of warp yarns interweaves with at least the lower layer of wefts, at least some of the first set of warps at least occasionally interweaving with the lower wefts and at least some of the second set of warps at least occasionally interweaving with the upper wefts.

Not all of the fist and/or second set of warps necessarily interweave with more than one layer of wefts. That said, it is preferable that all of the warps interweave with both layers of wefts.

In a preferred embodiment of the invention, the press felt has a paperside and a machine side and wherein the paperside comprises the same weave as the machine side.

In a preferred embodiment of the invention the first set of warp yarns interweaves in a plain weave with at least the upper layer of wefts.

In a further preferred embodiment the second set of warp yarns interweaves in a plain weave with at least the lower set of wefts.

The selection of a plain weave for all of the yarns, on both the paper side and machine side of the fabric, is advantageous in that this provides more uniformity of upthrust, i.e. the paper sheet is more evenly, and to a greater extent, supported. The yarns in a plain weave are also very highly secured in place and so the risk of base fabric collapse, as discussed with reference to prior art fabrics, is greatly reduced.

Although in the preferred embodiment a plain weave is used, other weave patterns are possible, such as a 3×1 broken twill pattern, Thus in a further embodiment of the invention the first set of warp yarns interweaves in a 3×1 pattern with at least the upper layer of wefts. In this embodiment the second set of warp yarns ideally interweaves in a 3×1 pattern with at least the lower layer of wefts.

Ideally the weave pattern is selected such that the total crimp length for each individual warp yarn is equal for each full weave repeat.

The preferred fabric of the invention is woven endless with a seam, although it can be woven as an endless loop.

In a preferred embodiment of the invention all of the wefts within the fabric are of the same diameter.

The diameter of single monofilament yarns would preferably be in the range from 0.20 mm to 0.60 mm, and ideally from 0.30 mm to 0.50 nm. Also, any variant of yarns used for press fabrics could be used. For example, 0.20 mm/2/2 cabled monofilament, 0.20 mm/2/3 cabled monofilament, 3 ply multifilament, combinations of multifilament and monofilament all could be used in endless versions of the weave pattern.

In order that the present invention may be more readily understood, specific embodiments thereof will now be described, by way of example only, with reference to the accompanying drawings in which:

FIG. 3 is a table showing the weave pattern of the fabric of FIG. 2;

Figure 1:
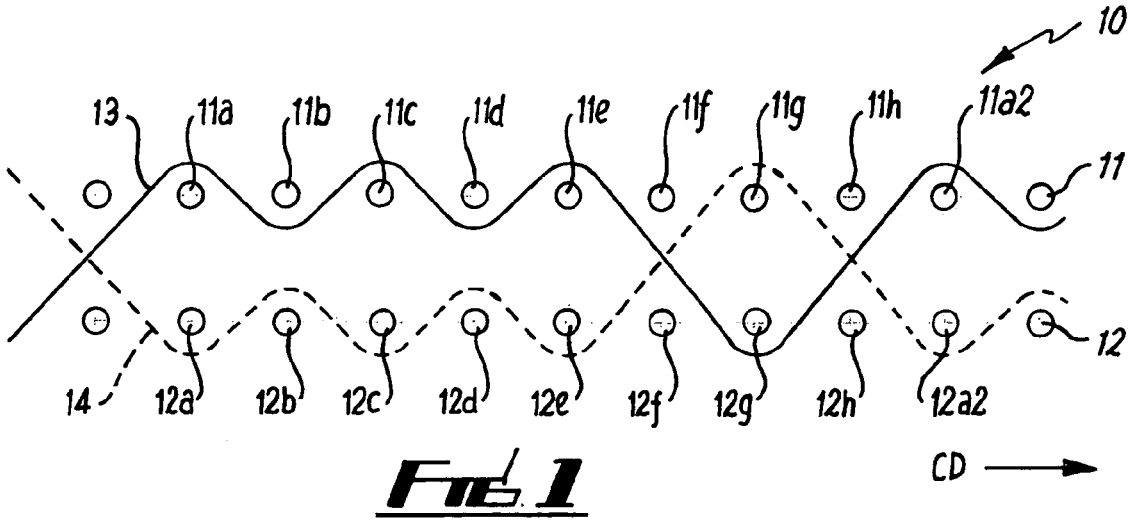
FIG. 1 is a side elevation of the base fabric of a first press felt in accordance with the present invention.

Referring to FIG. 1 an endless woven base fabric 10 for a press felt comprises an upper layer 11 of md weft yarns and a lower layer 12 of md weft yarns arranged in vertically aligned pairs.

A first cd warp yarn 13 interweaves in a plain weave with upper md yarns 11*a* to 11*e*. Similarly, a second cd warp yarn 14 interweaves in a plain weave with lower md yarns 12*a* to 12*e*. As can be seen in FIG. 1 the first cd yarn 13 then passes between the subsequent adjacent pair of md yarns 11*f*, 12*f* and then below the next adjacent lower md yarn 12*g* so as to form a knuckle around the base of that lower md yarn 12*g*, before travelling between the next adjacent pair of md yarns 11*h*, 12*h*. The first cd 13 then forms a knuckle over the next upper md yarn 11*a*2, where the weave pattern for that cd yarn 13 begins to repeat.

Similarly, as can be seen in FIG. 1, the second cd yarn 14 then passes from forming a knuckle on lower md 12*e*, between the subsequent adjacent pair of md yarns 11*f*, 12*f* so as to form a knuckle around the subsequent upper md yarn 11*g*. The cd yarn then travels between the next vertically aligned pair of md yarns 11*h*, 12*h* before forming a knuckle around the next lower md yarn 12*a*2, where the weave pattern for that cd yarn 14 begins to repeat.

Figure 2:
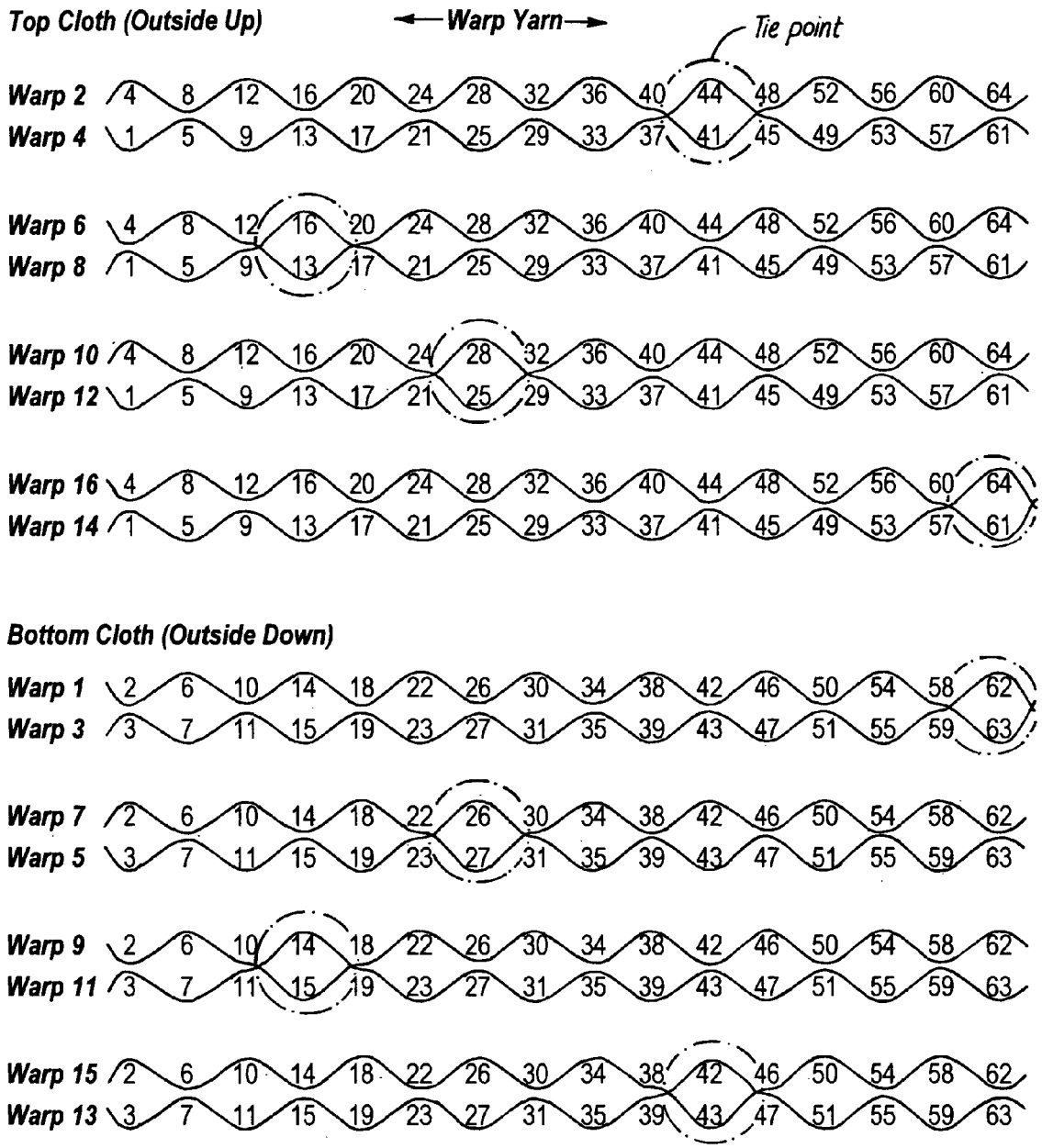
FIG. 2 shows the paths of the warps of the base fabric of a second press felt in accordance with the invention.

FIG. 2 shows all of the warp paths of a further double layer fabric in accordance with the present invention. It can be seen that this embodiment is very similar to that described in detail with reference to FIG. 1 except in that there are fewer binding warp cross-over points or tie points. A plain weave is used on both the paper side and machine side of the base cloth.

FIG. 3 is a table showing in detail the weave pattern of the press felt base cloth of FIG. 2. One shuttle has been used. The following key may be used to interpret FIG. 3.

Figure 4:
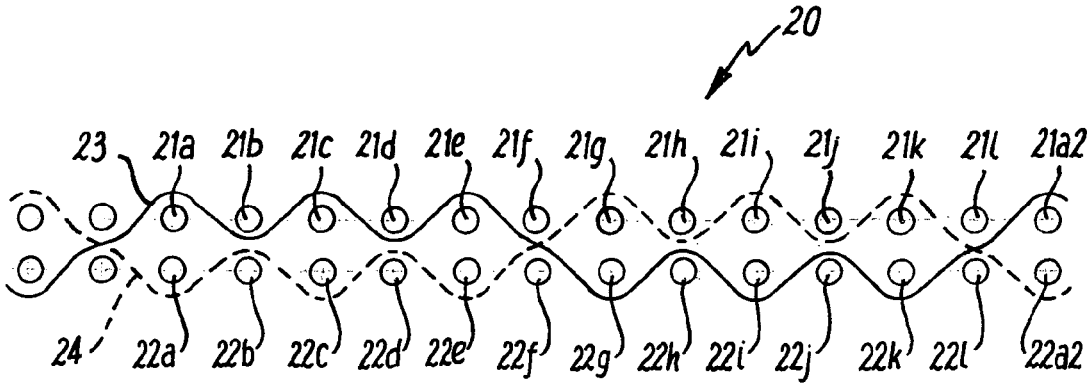
FIG. 4 is a side elevation of the base fabric of a third press felt in accordance with the present invention.

First Pick: from right, bottom of top cloth
Number=harness up (Down)
T=Top Cloth
B=Bottom Cloth
L=Pick from Left
R=Pick tom Right Referring to FIG. 4, a third endless woven fabric base 20 for a press fabric comprises upper and lower layers of md weft yarns 21, 22 arranged in vertically aligned pairs.

A first cd warp yarn 23 interweaves with upper md yarns 21*a* to 21*e* in a plain weave. Similarly a second cd warp yarn 24 interweaves with lower wefts 22*a* to 22*e* in a plain weave.

The first cd yarn 23 then travels, from forming a knuckle at weft 21*e*, inbetween the next vertical pair of md yarns 21*f*, 22*f* so as to form a knuckle around the base of the next lower md yarn 22*g*. The cd yarn 23 then interweaves in a plain weave with md yarns 22*g* to 22*k*, before travelling inbetween the next vertical pair of md yarns 21*l*, 22*l* and forming a knuckle around the next upper md yarn 21*a*2. The weave pattern for cd yarn 23 then repeats.

The second cd yarn 24 travels, from forming a knuckle around the base of md yarn 22*e* inbetween the next pair of md yarns 21*f*, 22*f* before forming a knuckle around the next upper md yarn 21*g*. The second cd yarn 24 then interweaves in a plain weave with ad yarns 21*g* to 21*k* before travelling between the next vertical pair of md yarns 21*l*, 22*l* and then forming a knuckle around the base of the next lower md yarn 22*a*2. The weave pattern for the second cd yarn 24 then repeats.

Figure 5:
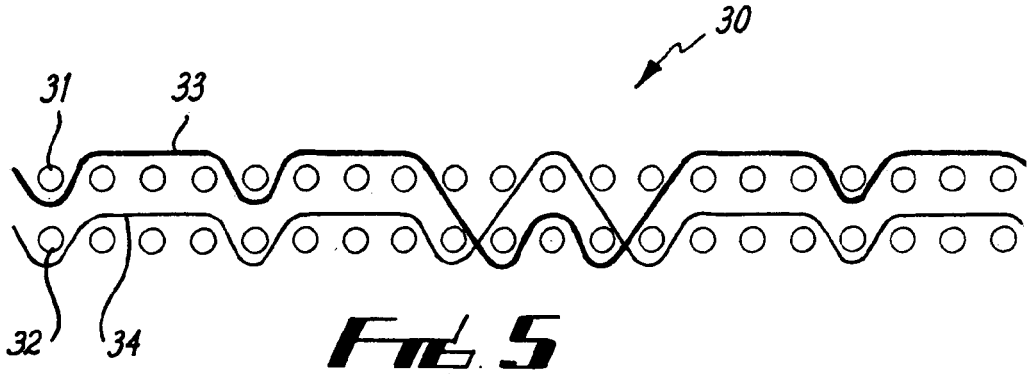
FIG. 5 is a side elevation of the base fabric of a further press felt in accordance with the present invention.

A further base cloth 30 of a press felt in accordance with the present invention is shown in FIG. 5. This double layer fabric has a 3×1 weave. This weave would be selected if more MD picks (than possible in a plain weave) were required or more internal or external CD yarn floats were desired.

The base cloth 30 comprises upper and lower md yarns 31, 32 arranged in vertically aligned pairs.

A first cd warp yarn 33 interweaves with upper md yarns 31 in a 3×1 weave. Similarly a second cd warp yarn 34 interweaves with lower wefts 32 in a 3×1 weave. A full repeat of the weave pattern is shown in FIG. 5.

It is noted, in this embodiment, that the lower warp 34 binds with the upper set of wefts with a single knuckle, whereas the upper warp 33 binds with the lower set of wefts in a plain weave forming knuckles around the base of two lower wefts. The upper warp 33 in this embodiment could just as well bind with the lower wefts by forming one knuckle around the yarn located between the two knuckles shown in FIG. 5. The predominant cd floats for either or both of yarns 33 and 34 could also be flipped upside down.

In use, the base fabrics of FIGS. 1 to 5 could have at least one layer of batt fibres and possibly other fabric layers needled thereto in conventional fashion.

Although woven as a so called 'endless fabric' the fabrics would conventionally have a seam extending in the cross machine direction. This seam may be achieved without difficulty as the binding warp yarns do not extend in the machine direction.

It is to be understood that the above described embodiments are by way of illustration only. Many modifications and variations are possible.

The invention claimed is:

1. A press felt comprising a base fabric, optionally with a batt of fibrous material secured thereto, the base fabric being woven endless and comprising upper and lower layers of weft yarns and first and second sets of warp yarns, wherein the first set of warp yarns interweaves with at least the upper layer of wefts and the second set of warp yarns interweaves with at least the lower layer of wefts, at least some of the first set of warps at least occasionally interweaving with the lower wefts and at least some of the second set of warps at least occasionally interweaving with the upper wefts, and wherein the base fabric has a paperside and a machine side and wherein the paperside comprises the same weave as the machine side.

2. A press felt as claimed in claim 1, wherein the first set of warp yarns interweaves in a plain weave with at least the upper layer of wefts.

3. A press felt as claimed in claim 1, wherein the second set of warp yarns interweaves in a plain weave with at least the lower sets of wefts.

4. A press felt as claimed in claim 1, wherein the first set of warp yarns interweaves in a 3×1 pattern with at least the upper layer of wefts.

5. A press felt as claimed in claim 1, wherein the second set of warp yarns interweaves in a 3×1 pattern with at least the lower layer of wefts.

6. A press felt as claimed in claim 1, wherein the fabric comprises a seam.

7. A press felt as claimed in claim 1, wherein the fabric does not comprise a seam.

8. A press felt as claimed in claim 1, wherein all of the wefts within the base fabric are of the same diameter.

* * * * *